United States Patent [19]

Del Bon et al.

[11] Patent Number: 4,493,444

[45] **Date of Patent: * Jan. 15, 1985**

[54] SELF-CLOSING VALVE-AND-LID ASSEMBLY

[76] Inventors: Luigi Del Bon, 141, Feldstrasse; Franco Del Bon, 139, Feldstrasse, both of 4663 Aarburg, Switzerland

[ * ] Notice: The portion of the term of this patent subsequent to Apr. 17, 2001 has been disclaimed.

[21] Appl. No.: 347,321

[22] Filed: Feb. 9, 1982

Related U.S. Application Data

[63] Continuation-in-part of Ser. No. 259,158, Apr. 30, 1981, Pat. No. 4,442,959, and Ser. No. 259,159, Apr. 30, 1981, Pat. No. 4,410,110.

[30] Foreign Application Priority Data

Apr. 30, 1980 [EP] European Pat. Off. ..... 81.105298
Aug. 5, 1980 [CH] Switzerland ..... 5912/80

[51] Int. Cl.[3] ..... B65D 83/14

[52] U.S. Cl. ..... 222/402.22; 222/402.24; 251/354

[58] Field of Search ..... 222/402.1, 402.13, 402.15, 222/402.21, 402.22, 402.23, 402.24, 402.25, 501, 511, 512, 513, 514, 518; 251/354

[56] References Cited

U.S. PATENT DOCUMENTS 2,662,668 12/1953 Schmidt .
2,662,669 12/1953 Schmidt .
2,696,934 12/1954 Ashton .
2,761,593 9/1956 Spiess et al. ..... 222/490 X
2,845,203 7/1958 Potash ..... 222/514
2,863,699 12/1958 Elser ..... 222/514 X
3,144,179 8/1964 Gildone ..... 222/402.25 X
3,272,403 9/1966 Alexander ..... 222/518 X
3,323,695 6/1967 Monahon ..... 222/402.13 X
3,348,742 10/1967 Assalit ..... 222/402.25 X
3,434,633 3/1969 Green ..... 222/402.22
3,540,634 11/1970 Mayercik ..... 222/402.21
3,613,728 10/1971 Steiman ..... 222/402.24
3,633,798 1/1972 Webster ..... 222/402.22
4,171,074 10/1979 Diamond ..... 222/402.22

FOREIGN PATENT DOCUMENTS 2048915 3/1971 France .
2354260 1/1978 France .

*Primary Examiner*—F. J. Bartuska
*Attorney, Agent, or Firm*—Heinrich W. Herzfeld

[57] ABSTRACT

A valve-and-lid assembly comprises a self-closing discharge valve constituted by a dome part, having a central opening, of a lid closing the open top end of a pressurized container and serving as the obturating member of the valve by obturating ducts through a valve disc of elastically resilient material which is lodged in the dome part. When opening the valve by downward or tilting pressure exerted with the aid of a tubulure or the like actuating member on the valve disc, the latter is deformed so as to establish free communication between at least one of the ducts therein and the hollow interior of the tubulure which can carry a conventional atomizer head having a spray nozzle.

22 Claims, 23 Drawing Figures

LP
CA
P1
P2
P1'
-5-
-27-
-30-

FIG.12
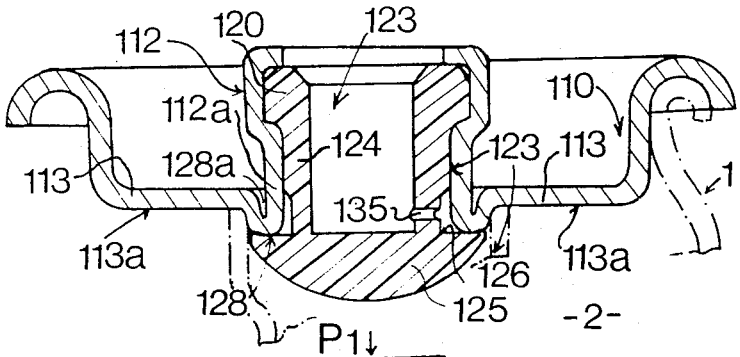
FIG.13
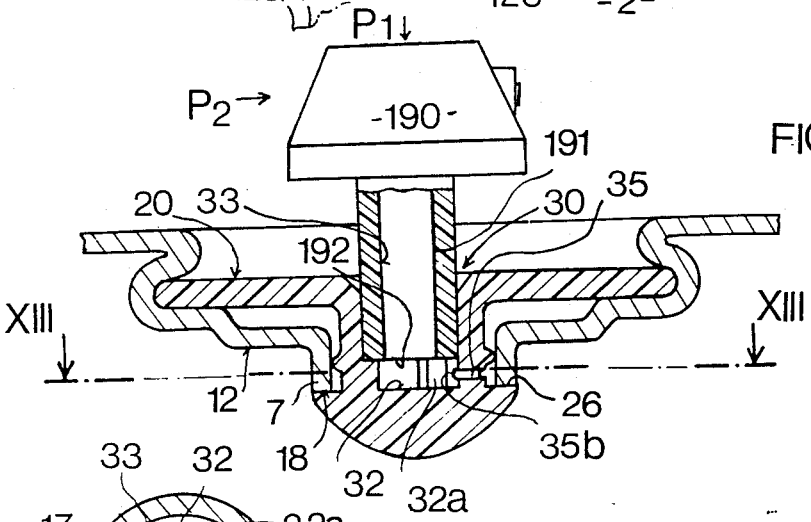
FIG.15
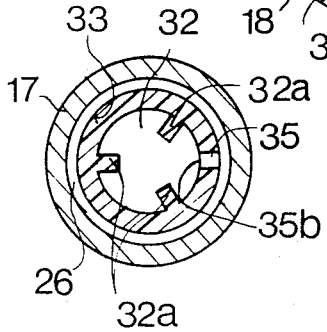
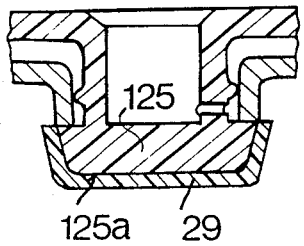
FIG. 14

FIG.16
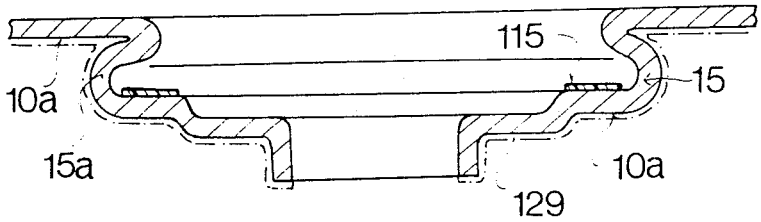
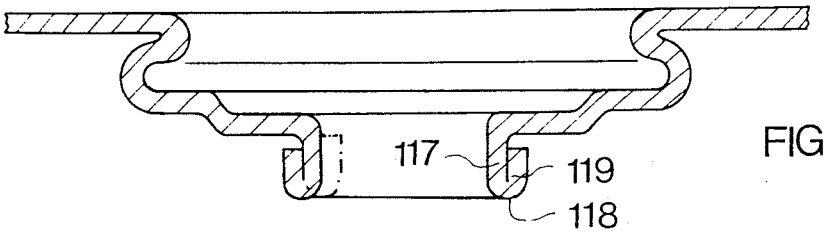
FIG.17
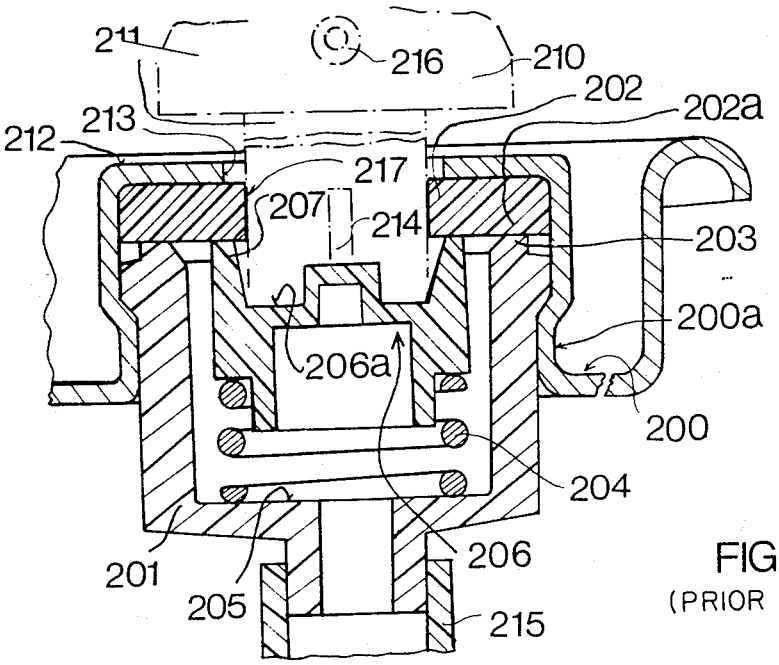
FIG.18
(PRIOR ART)

SELF-CLOSING VALVE-AND-LID ASSEMBLY

RELATIONSHIP TO EARLIER APPLICATIONS

This application is a continuation-in-part of my pending patent applications Ser. Nos. 259,158 now U.S. Pat. No. 4,442,959 and 259,159, now U.S. Pat. No. 4,410,110, both filed on Apr. 30th 1981.

BACKGROUND OF THE INVENTION

This invention relates to a self-closing valve-and-lid assembly adapted for closing the open top end of a container fillable with pressurized product. It also refers to a novel lid and valve disc, both of which are suitable for being used in the novel valve-and-lid assembly.

Valve-and-lid assemblies which are used to close the open top end of a can or the like container, especially such container destined to be filled with a preferably liquid product and a pressurizing agent, are well known in the art of aerosol cans and are described in numerous patents and other publications.

For instance, German Offenlegungsschrift No. 27 22 265 of George Bernard Diamond describes a pressurized can which is closed off at the top by a lid, preferably of metal such as aluminium, and which is equipped with a discharge valve mounted in the center of the lid, on a common central axis of the valve-and-lid assembly.

The valve is provided with a product passage, a valve disc or plate having a central opening, and with a valve body which cooperates with the valve disc to obturate the product passage when the valve is in closed position; at least one of the two aforesaid valve elements is usually made of an elastically resilient material.

The lid comprises a centrally located dome part which protrudes, in the shape of an inverted cup or bell, from a main lid plane in which a flat part of the lid surrounding the dome part extends, and which plane extends radially to the above-mentioned central axis. The dome part is provided with a central opening coaxially with that of the valve disc and is crimped or stamped in another suitable manner to hold the peripheral zone of the valve disc in a fast, liquid- and gas-tight manner. The periphery of the lid is sealingly connected with a top rim of the container sidewall surrounding the said container top opening, and extends generally to the said central assembly axis.

The lid including the dome part thereof must usually be rigid under conditions of filling product (and, of course, propellant of such is used) into, and of discharging product (and propellant) from the container.

When opening the valve, the valve disc and valve body are so changed in their position relative to one another that there opens a gap between them which permits the flow of product through the product passage of the valve to the outside.

However, in this known valve and all others that have come to our knowledge, the manufacture of the movable part, i.e. the valve body which carries a valve stem and on the latter often an atomizer head, is relatively complicated, especially when it is to be manufactured by means of modern injection molding techniques. Moreover the known valves often require costly spring means for biassing the valve body into its closing position.

It is another drawback of known valve-and-lid assemblies that insertion of a sleeve or stem part of an atomizer head or of a filling head used for introducing product and/or propellant into the interior of a container leads frequently to damage of parts of the valve, especially the small elastically resilient valve disc or gasket that these valves usually require.

OBJECTS AND SUMMARY OF THE INVENTION

It is, therefore, an object of the present invention to provide a valve-and-lid assembly, the manufacture of which is simpler than that of the known assemblies and which requires a minimum number of parts, each of which is in itself easy to manufacture.

It is another object of the invention to provide a valve-and-lid assembly in which spring means can be dispensed with and which nevertheless guarantees satisfactory sealing and operation of the valve.

A further object of the invention is to provide a valve-and-lid assembly in which an atomizer head stem or sleeve or a filler head can be introduced easily without damaging any sensitive parts thereof such as an elastically resilient gasket.

These and other objects of the invention which will become apparent from the following description thereof, are attained in accordance with the invention in the initially described self-closing valve-and-lid assembly, which comprises:

(1) a lid the periphery of which is adapted for being sealingly connected with a top rim of a container sidewall surrounding the container top opening, and extending generally transverse to the central assembly axis, which lid has a central dome part and a central opening in the middle of the dome part, and is rigid under conditions of filling product into, and discharging product from said container;

which lid has a flat lid part about the dome part and extends generally in a main lid plane transverse to the central assembly axis, while the dome part has a top wall and a circumferential sidewall which latter extends generally out of the main lid plane, and comprises a collar portion protruding from said dome top wall and extending substantially axially relative to said central assembly axis and ending in an annular rim about said central dome part opening;

a valve disc being elastically resilient under the above-defined conditions and having a peripheral disc zone, said valve disc having an outer surface adapted for facing away from a container and an opposite inner surface adapted for facing toward the interior of the container, and comprising an annular contact zone of said disc being disposed coaxially about said central assembly axis, and being, in closed state, in sealing contact with at least said collar portion of said dome part, and at least one duct extending through said valve disc and having a first orifice in said outer disc surface thereof and a second orifice in said inner disc surface and opening out of the latter surface, within the area defined by the outer periphery of said annular contact zone; and finger-engageable actuating means for deforming said disc in a manner such that at least part of said inner disc surface bearing said annular contact zone is moved out of engagement with said collar portion, thereby opening a free passage through at least one duct from the space adjacent said inner disc surface about said annular contact zone to outside said outer disc surface.

In preferred embodiments of the self-closing valve-and-lid assembly according to the invention, the collar portion protrudes from the dome part top wall on the side thereof adapted for facing toward the interior of the container, the valve disc comprises a valve head depending from said inner surface valve disc and extending through said central opening of said dome part to outside said collar portion and having a sidewall and a contact face thereon which, in closed state, is in sealing contact with at least said collar portion, preferably below said main lid plane, and the second orifice of said duct is in said sidewall of said valve head above at least a first portion of said contact face.

In a preferred embodiment of the valve-and-lid assembly according to the invention, the valve head comprises (a) a reduced radial diameter stem part depending from the underside face of the valve disc and extending axially relative to the central assembly axis, (b) a valve head button at the lower end of the stem part being of larger radial diameter than the stem part, and (c) an annular shoulder on the valve head button facing toward the collar portion and constituting the said contact face of the valve head, while the said other orifice of the duct is provided in the stem part sidewall.

In preferred embodiments of the valve-and-lid assembly according to the invention, the dome part of the lid protrudes downwardly from the main lid plane, depending from the flat lid part on the side of the latter which is turned toward the interior of the container the open end of which is closed off by the lid.

More particularly, in preferred embodiments, the circumferential sidewall of the dome part of the lid comprises an annular crimped region firmly clamping a peripheral zone of the valve disc; and the dome top wall is vaulted away from the main lid plane below the crimped sidewall region to provide a hollow space between the vaulted top wall and the underside face of the valve disc which is lodged inside the clamped-in peripheral zone of the disc.

In an especially preferred embodiment, the distance of the annular shoulder on the valve head button from the underside face of the valve disc, prior to being mounted in the valve-and-lid assembly, is shorter than the distance between the same two disc elements when the disc is mounted in the dome part, thereby imparting a bias to the annular shoulder against the annular rim of the collar portion, and obtaining a stronger sealing effect.

At the same time, in this embodiment, the whole valve disc can be so firmly held in place, that the above-mentioned crimped fold of the dome part clamping-in the periphery of the valve disc can be dispensed with.

While, in preferred embodiments of the valve-and-lid assembly of the invention, the dome part protrudes downwardly from the flat lid part toward the interior of the container, the dome part can also protrude upwardly, from the main lid plane, thus rising above the flat lid part on the outside, above the outer face of the latter; in this case, the collar portion consists of an annular bead means about said central opening of said dome part and protrudes downwardly out of the main lid plane on the underside of the flat lid part which is turned toward the interior of the container.

In another aspect, the invention provides a container lid which is usable in the above described self-closing valve-and-lid assemblies, the periphery of the lid being adapted for sealing connection with a top rim of a container sidewall surrounding the container top opening, which lid has a central dome part and a central opening in the middle of the dome part, and is rigid under conditions of filling product into, and discharging product from said container, and is preferably made of metal;

the lid has a flat lid part, about the dome part, extending generally in a main lid plane transverse to the central assembly axis, and the dome part has a top wall and a circumferential sidewall which latter extends generally out of the main lid plane, and comprises a collar portion which extends axially relative to the central lid axis and ends in an annular rim about the central dome part opening;

and the collar portion extends from the dome part downwardly away from the main lid plane on the side of the lid destined to face toward the interior of the container.

Preferably, the whole dome part protrudes from the flat lid part on the side of the latter destined to face toward the interior of the container. If it does not, at least the collar portion should always do so.

In yet another aspect, the invention provides a novel valve disc adapted for being mounted in a self-closing valve-and-lid assembly according to the invention, which valve disc is of a material which is elastically resilient under conditions of filling product into, and discharging product from the container, and has an outer face destined to face away from the container and an opposite underside face which is to face toward the interior of the container;

this valve disc comprises a valve head depending from the underside face of the disc and having a sidewall and bearing a contact face which, in closed state, is adapted to be brought in sealing contact with the rigid contact means of the lid in which the valve disc is destined to be mounted; the valve head further comprises at least one duct having an orifice in the outer disc face and another orifice in the said sidewall of the valve head above the contact face thereof.

Preferably, the valve disc consists of a synthetic resin material selected from the group consisting of a polyester elastomer of the Hytrel 4055 type and an ethylene-vinyl acetate copolymer resin of the Elvax 3120 type.

Elvax 3120 is an ethylene-vinyl acetate copolymer resin made by E. I. Dupont de Nemours, Wilmington, Del., it contains 7.5 weight-% of vinyl acetate units and has a density of 0.93 g/cm$^3$ and a melt index of 1.2 g/10 min (ASTM D-1238), while the even more preferred polyester elastomer Hytrel 4055, which is also made by Dupont, has a melting point of 168° C., a softening point of 112° C., a density of 1.17 and a tensile strength of 415 kg/cm$^2$. Further details about these substances can be found in pamphlets of the above-mentioned American company.

This object and others which will become apparent from the following description of the invention are attained in a self-closing valve-and-lid assembly of the initially described type comprising (a) a lid the periphery of which is adapted for being sealingly connected with a top rim of a container sidewall surrounding the said container top opening, and extending generally transverse to a central assembly axis which lid has a central dome part and a central opening in the middle of the dome part, and a flat lid part about the dome part and extending generally in a main lid plane transverse to the central assembly axis, the lid being made of a material which is rigid under conditions of filling product into, and discharging product from the container, a collar portion of said dome part extending axially relative to said central assembly axis and ending in an annular rim about said central dome part opening;

the dome part having a top wall and a circumferential sidewall which latter extends generally out of the main lid plane, and the collar portion extending from said dome part top wall toward the main lid plane, but ending at or near the latter plane;

(b) a valve disc being of a material which is elastically resilient under the above-defined conditions, and having a peripheral disc zone which is firmly clamped in the central dome part, and a central contact zone of the disc being, in closed state, in sealing contact with at least the collar portion of the dome part; the valve disc having an inner disc face thereof turned toward the collar portion, and at least one duct extending through the disc from a face thereof turned away from the contact zone to the said inner disc face and opening out of the latter face in the central contact zone; and (c) finger-engageable actuating means which, when actuated, so deforms the valve disc in the range of the said central contact zone that at least part of the contact zone is moved out of engagement with the collar portion, thereby opening a free passage through at least one duct from outside the disc face turned away from said contact zone to outside said central opening of said dome part.

Preferably, the dome part protrudes from the flat lid part on the side thereof adapted to be turned toward the interior of the container.

In certain embodiments of the valve-and-lid assembly, a riser tube can be inserted in the collar portion and extend into the container interior, opening in a bottom zone of the container.

The interior of the riser tube is in communication with the duct or ducts of the valve disc when the latter is deformed by transverse pressure on the actuating means to open a gap between the lid surface and the valve disc surface in contact therewith, while such communication is interrupted when the valve disc is at rest or closure position in the dome part.

The actuating means can comprise a valve actuating rod which is mounted centrally on the outside surface of the valve disc, and an enveloping, preferably conical mantle having a discharge opening at its top end or apex and a circumferential foot rim which is connected with the same outside surface of the valve disc but outside the outlets of the ducts of the valve disc.

The opening at the apex is closed, in rest position, by the preferably conically tapered tip of the rod, thus providing a second sealing in addtion to the primary sealing effect between the valve disc and lid. This double seal does not require any special precision manufacturing and will nevertheless be satisfactory when pressures prevailing in the container on the product are 3 to 5 bars in excess of ambient pressure.

In preferred embodiments of the valve-and-lid assembly of the invention, it is particularly easy to fill product and/or propellant into the container after the valve-and-lid assembly has been firmly mounted on the container top rim, for instance by peripheral crimping in a manner known per se. No tilting or depression of an actuating member is required during filling.

It is one advantage of the valve-and-lid assembly of the invention that a riser tube use of which is preferred in certain types of aerosol spray cans, can be mounted directly on the lid rather than on the valve housing conventionally used in such cases.

BRIEF DESCRIPTION OF THE DRAWINGS

Further objects, interesting features and other details of the invention will become apparent from the following description of preferred embodiments of the invention in connection with the accompanying drawings in which

FIG. 12 shows a similar view of a fifth embodiment of the valve-and-lid assembly of the invention;

FIG. 13 is an axial sectional view of the embodiment of FIG. 1, and an atomizer head as actuating means; and FIG. 14 is a cross sectional view of the same embodiment, taken in a plane indicated by XIV—XIV in FIG. 12;

FIG. 15 is a view similar to FIG. 1 but with a protection cover for the valve head button;

FIGS. 16 and 17 show further details of variations of the lid in the embodiment shown in FIG. 1, and FIG. 18 shows in axial section a prior art valve-and-lid assembly in a conventional spray can;

DETAILED DESCRIPTION OF THE EMBODIMENTS SHOWN IN THE DRAWINGS

Figures 1, 2:
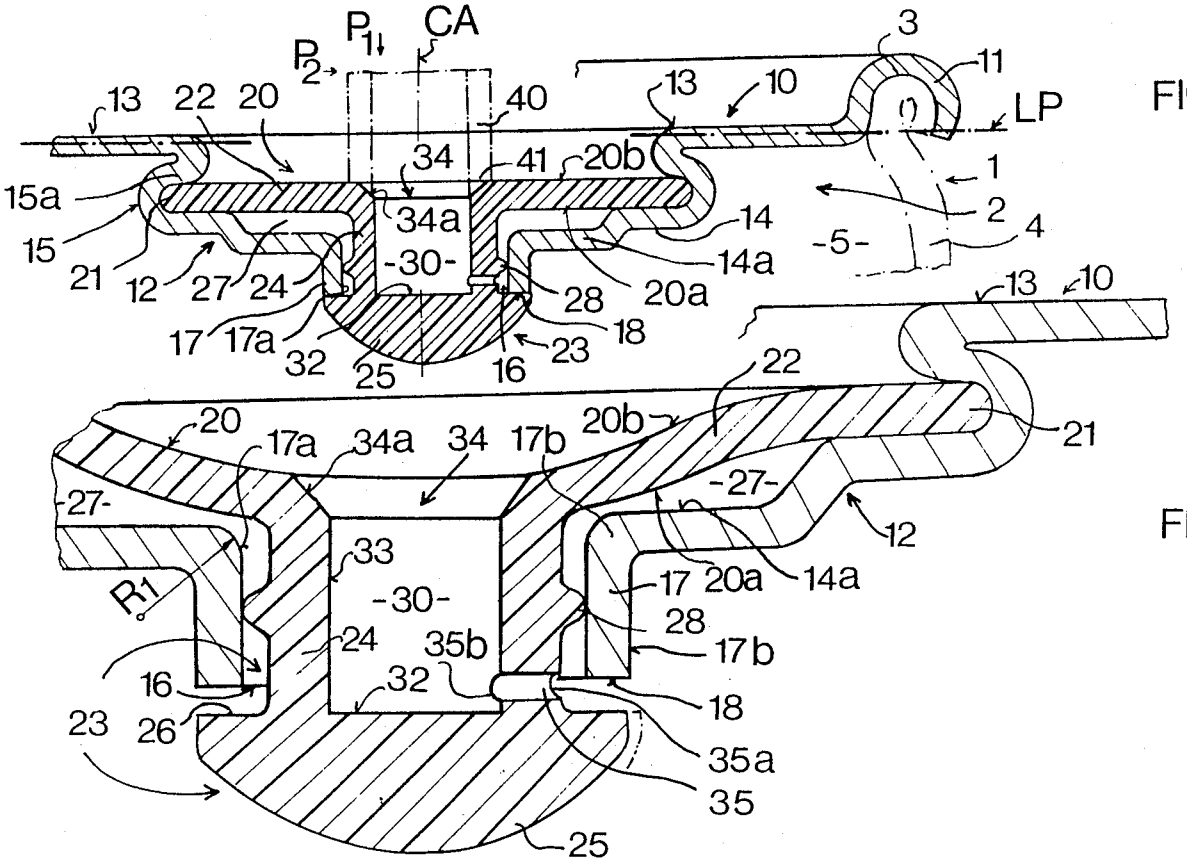
FIG. 1 is a sectional view, taken in a plane through the central assembly axis, of a first, preferred embodiment of the valve-and-lid assembly of the invention, with the part in closed position, but without the actuating means.
FIG. 2 is a similar view of the same embodiment, with parts in open or discharge position.

In the preferred embodiment of a valve-and-lid assembly according to the invention shown in FIGS. 1 and 2, the lid 10 closes a can or the like container having an open end 2 at the top thereof which open end is surrounded by a top rim 3 of a can sidewall 4. The periphery 11 of the lid 10 is sealingly connected to can rim 3, thus closing off the interior 5 of can 1, which can be filled with a liquid product under pressure by a propellant.

The lid 10 has a central dome part 12 which is surrounded by a flat lid part 13, extending in a main lid plane LP which is radial to a central assembly axis CA. The dome part 12 protrudes from the lid plane LP downward toward the interior 5 of can 1.

The dome part 12 has a top wall 14 and a circumferential sidewall 15, as well as a central opening 16 in the top wall 14 which is surrounded by an axially downwardly extending collar portion 17 that depends from the dome top wall 14. At its lower, free end the rim 18 of collar portion 17 serves as a contact and sealing element to be engaged by a corresponding portion of a valve disc.

The sidewall 15 of the dome part 12 comprises an annular region 15*a* which is crimped to firmly clamp in a peripheral zone 21 of a valve disc 22 being the upper portion of a valve body 20. The disc 22 extends across the base of dome part 12 and bears on its underside face 13, turned toward the interior 5 of can 1, an approximately mushroom-shaped active valve part 23 which depends from underside face 20*a* to extend axially through the central dome opening 16 and to end beneath the rim 18 of collar portion 17.

The valve part 23 shown in FIGS. 1 and 2 comprises a stem part 24, of reduced radial diameter, which depends from the central portion of valve disc 22 and bears at its lower end, at the level of collar portion rim 18, a valve head 25 of larger radial diameter than the stem part 24. Thus there is formed at the junction of parts 24 and 25 a shoulder 26 which, in the embodiment of FIGS. 1 and 2, extends in a plane parallel to the main lid plane LP.

In the central region of the top wall 14 of dome part 12 the top wall region 14*a* is vaulted further away from the main lid plane LP so as to provide a hollow space 27 between the inner surface of vaulted top wall region 14*a* and the underside face 20*a* of valve disc 22.

The valve stem part 24 is further provided on its outer surface with an annular sealing rib 28 which protrudes radially from the outer surface of stem part 24 and engages the opposite inner wall surface 17*a* of collar portion 17 slidingly and sealingly at all times.

In the embodiment of FIGS. 1 and 2, the valve part 23 has a cavity 30 therein which has a bottom 32 and is enclosed by a sidewall 33 of stem part 24 and has a top opening 34 in outer valve disc face 20*b*. A duct 35 extends through the stem part 24 from a first, entry orifice 35*a* in the outside wall surface 24*a* of stem part 24 to a second, exit orifice 35*b* in the sidewall 33 of cavity 30.

The actuating means of this embodiment is indicated by phantom lines in FIG. 1. It can be a tubular sleeve 40, for instance, of an atomizer head of the type used conventionally with spray cans. The lower end 41 of sleeve 40 can be tapered and fit in the correspondingly bevelled rim 34*a* about cavity opening 34 in top face 20*b* of valve disc 22.

When finger pressure is exercised on the actuating means comprising sleeve 40, in axial direction as indicated by arrow $P_1$, then the central region of the valve disc 22 together with active valve part 23 is moved downward to a position as shown in FIG. 2. In this "open" position, obturating shoulder 26 of the valve head 25 has moved out of engagement with rim 18 of collar portion 17 and frees a path for product (and optionally propellant) from the can interior 5 into entry orifice 35*a* of duct 35, and through duct 35 via exit orifice 35*b* into cavity 30 and further through central passage 42 of actuating sleeve 40, which registers with the cavity 30, on to the spray nozzle (not shown) of an atomizing head mounted on sleeve 40.

At the same time, sealing rib 28 remains constantly in sealing contact with the inner wall surface 17*a* of collar portion 17, thus preventing penetration of product into the space 27, in which product could age and dry up and thus impede proper actuation of the valve body 20. It is therefore particularly important that the entry orifice 35*a* or duct 35 is located between shoulder 26 and sealing rib 28 of the valve head 23.

Pressure can also be applied in transverse, tilting direction as indicated by arrow $P_2$.

Of course, several ducts 35 can be provided, in particular, regardless of whether the valve is to be opened by axial finger pressure (Arrow $P_1$) or by tilting (Arrow $P_2$).

The space 27 between valve disc 22 and the inner face of the vaulted dome top wall region 14*a* facilitates downward deformation of valve disc 22 as shown in FIG. 2. The radius $R_1$ of the curvature at the junction 17*b* of dome top wall region 14*a* and collar portion 17 must be large enough to avoid too early an abutment of the underside disc face 20*a* against the junction 17*b*. This junction can also be provided with an annular bevel (not shown).

An important advantage of the structure of the embodiment shown in FIGS. 1 and 2 resides in the fact that pressure prevailing in the can interior 5 acts upon the rounded end surface of valve head 25 in a direction which enhances the sealing pressure of button shoulder 26 against the contact rim 18 of collar portion 17.

Another important advantage resides in the fact that the important deformable portions of the valve disc do not come into contact with the liquid product in, or being discharged from the can 1, but remain in contact with air only. Deformation of the valve disc 22 and also axial lengthening of the stem part 24 in the "open" position are facilitated by the polymer fiber structure of the deformable element. This axial lengthening occurs particularly when deforming "opening" pressure is exercised directly on the bottom 32 of cavity 30 (see the description of FIGS. 12 and 13 below).

A further advantage of the valve-and-lid assembly, especially as shown in FIGS. 1 and 2, resides in the facility of filling the can 1 through the assembly which is already mounted in place across the can opening 2, avoiding damage to the valve parts.

The elastic nature of the wall of stem part 24 also enhances the sealing effect of annular sealing rib 28 on the inner wall 17*a* of collar portion 17.

Figure 3:
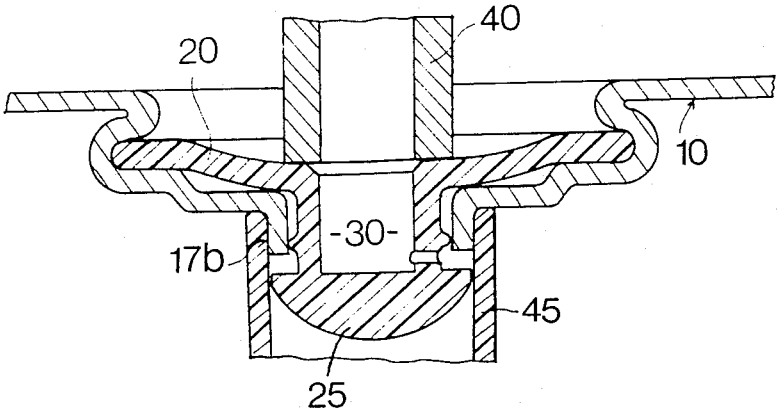
FIG. 3 is a similar view as FIG. 2, showing a first type of actuating means.

In the assembly shown in FIG. 3, the actuating member comprises a separate sleeve 40 which rests on the outer valve disc face 20B and a riser tube 45 is attached to the outside wall 17*b* of collar portion 17. The riser tube 45 must be wide enough to stay clear of valve head 25 at all times, and can be mounted by widening its internal diameter by heating the tube end, placing it about collar portion 17 and then shrink-seating it on the latter by cooling.

In FIG. 3 and all subsequent Figures, all parts having the same function and practically similar shape as in the embodiment of FIGS. 1 and 2 are designated by like numerals.

Figure 4:
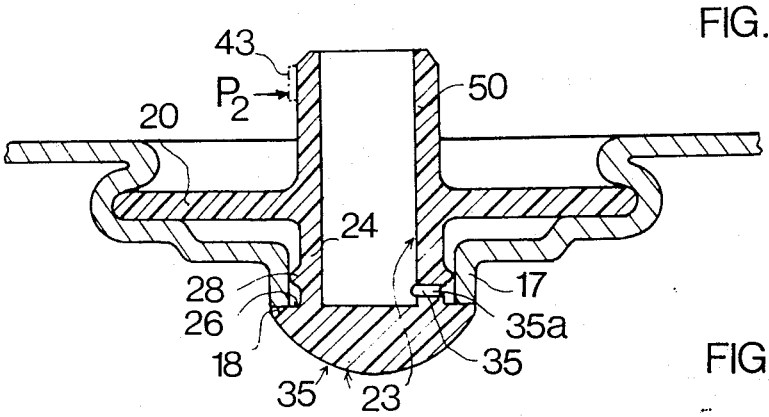
FIG. 4 is another view like FIG. 1, with a different type of actuating means.

In the embodiment shown in FIG. 4, the actuating member is a tubular sleeve 50 integral with the valve body 20. Duct or ducts 35 are provided only on the right hand side of the stem part 24 in this figure, and correspondingly, a small button or the like projection 43 on the opposite side of sleeve 50 indicates the side on which radial pressure (arrow $P_2$) must be exerted when opening the valve by tilting sleeve 50 and valve part 23 together therewith, to the right in FIG. 4, thereby moving shoulder 26 out of engagement with the right hand zone of rim 18 of collar portion 17 and freeing orifice 35*a*.

Figure 5:
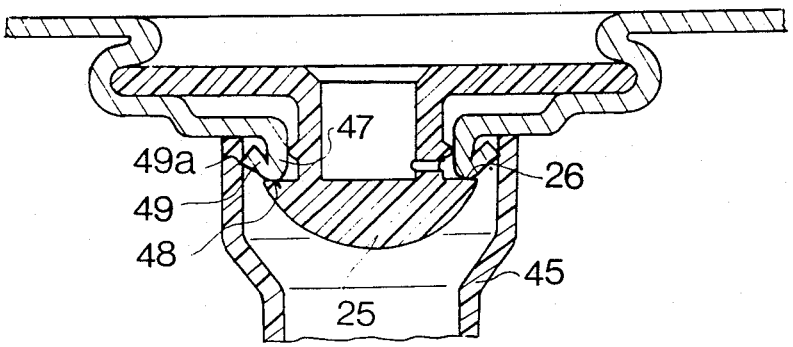
FIG. 5 is a view similar to that of FIG. 1 in which the assembly comprises a riser tube.

FIG. 5 shows an improved way of mounting the riser tube 45 on the collar portion 47. The latter has its lower free end crimped outwardly to provide an outer collar flange 49. The curved crimping bend of the collar portion 47 provides an advantageous configuration for the rim 48 against which shoulder 26 of valve head 25 abuts with improved sealing effect. At the same time, the outer edge 49*a* of collar flange 49 cuts into the material of the heat-widened top portion of riser tube 45 when the latter is cooled, providing a particular safe hold of the tube on collar flange 49. Also, the riser tube is spaced further away from the shoulder 26 of valve head 25 than in the embodiment of FIG. 3.

Figure 6:
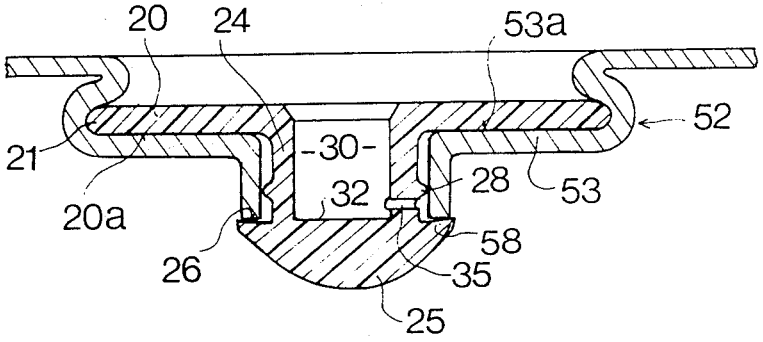
FIG. 6 shows in axial sectional view a different embodiment of the valve-and-lid assembly.

In FIG. 6, there is shown another embodiment in which the valve disc underside face 20*a* rests on the flat upper surface 53*a* of flat top wall 53 of dome part 52.

In this embodiment the elastomer material of which the valve body 20 is made must be particularly longitudinally stretchable, as only then axial pressure exerted on the bottom 32 of cavity 30 will stretch especially the stem part 24 sufficiently to move shoulder 26 of valve head 25 out of engagement with collar portion rim 58 and free duct 35.

Figure 7:
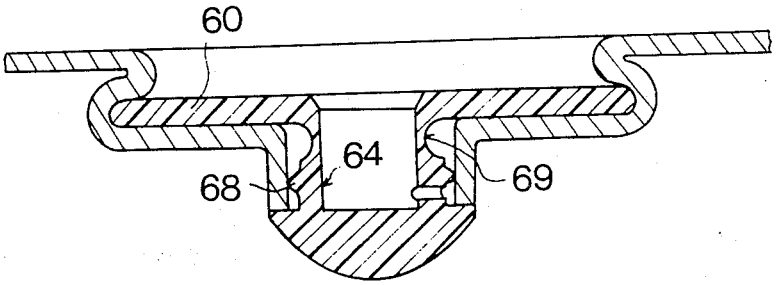
FIGS. 7 and 8 show axial sectional views of details of the valve head.

The stretchability especially of the stem part 64 of valve disc 60 in the embodiment shown in FIG. 7 is further enhanced by providing in the stem part zone above sealing rib 68 an annular zone 69 of reduced thickness.

Figure 8:
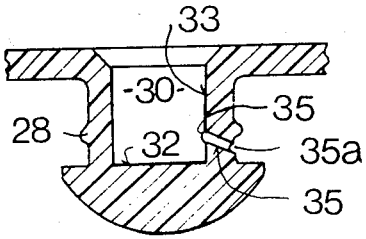

Outflow of product through duct 35 is particularly facilitated by having the duct inclined inwardly and upwardly in the direction of product flow therethrough, (FIG. 8) by having the entry orifice 35*a* located at a lower level, nearer shoulder 26 of valve head 25 than the exit orifice 35*b* which is located in the inner wall surface 33 of cavity 30 preferably at the same level above the cavity bottom 32 as sealing member 28.

Figure 9:
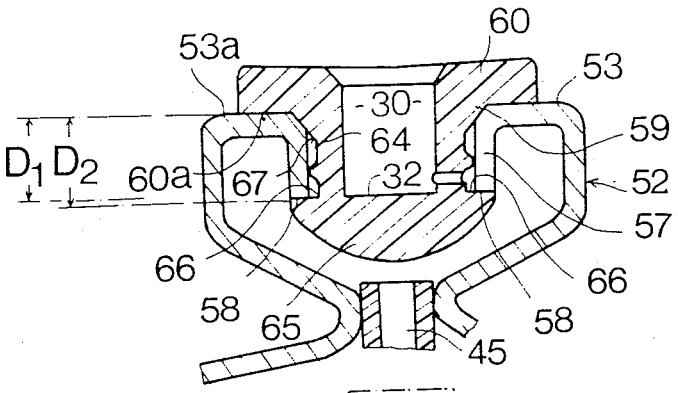
FIGS. 9 and 10 show axial sectional views of a third and of a fourth embodiment.

Especially in an embodiment having no free space intermediate the flat region of valve disc 60 and the dome part top wall 53 underneath the same, a preferred manner of mounting the valve disc in the lid dome part affording a particular firm seat and improved sealing action between the shoulder 66 of valve head 65 and the rim 58 of collar portion 57 is achieved by providing, at manufacture of the valve disc 60, a distance $D_1$ between the underside face 60*a* of valve disc 60 and shoulder 66 thereof which is smaller prior to mounting the valve disc in the dome part 52, than is the distance $D_2$ between the upper surface 53*a* of flat dome part top wall 53 and the rim 58 of collar portion 57 of the dome part 52 (FIG. 9). By the stretching of the distance $D_1$ to become equal to $D_2$ when mounting the valve disc 60 in the dome part 52, there is obtained an additional bias of shoulder 66 against collar portion rim 58. Also, the outer wall zone in which the underside face 60*a* of the valve disc 60 merges with the stem part 64 can be devised as a conically bevelled annular zone 67 which is urged against the bended junction zone of flat top wall 53 with collar portion 57, thus adding an additional contact zone and enhanced biasing and sealing effect to the annular zone 6 which helps to keep valve disc 60 and the upper portion of stem part 64 rigid while only the lower stem part is stretched when opening a gap between elements 58 and 66 by pressure on bottom 32 of cavity 30. In this case the valve disc 60 is held so fast in position in dome part 52 that a crimping of the dome sidewall to clamp in the periphery of valve disc 60 can be dispensed with. In the embodiments of FIGS. 1 to 5 a similar manner of mounting the valve disc in the dome part will not offer quite the same advantages, as the disc will be bent inwardly in closed position, and its path of travel during opening may become too short. In FIGS. 1 and 6 however, the same advantages can be obtained when mounting the valve disc in the dome part in the same manner as in the case of FIG. 9, because the disc periphery 21 is clamped in.

Figure 10:
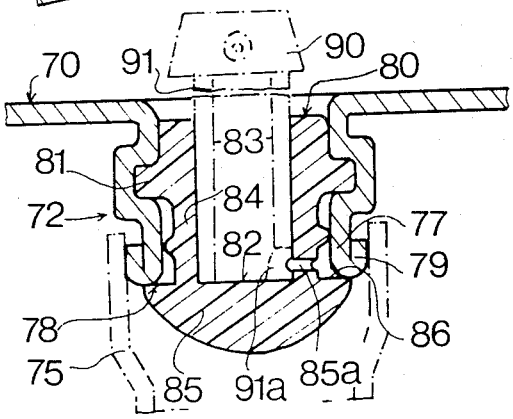

In the embodiment of FIG. 10, the lid 70 has a dome part 72 which contains an annular crimped zone about the peripheral rim 81 of a valve disc 80. The shoulder 86 of valve head 85 rests firmly against the rounded rim 78 which is formed by crimping the end zone of collar portion 77 upward to form an outer cuff part 79.

Actuation must, in this case, be by means of a hollow sleeve 91 of an actuating head 90 (indicated in phantom lines) which acts upon the bottom 82 of cavity 83 in the valve head stem part 84.

Sleeve 91 is provided with a cutout or port 91*a* at the bottom end thereof to permit product flow from duct 85*a* into the hollow interior of sleeve 91.

A riser tube 75 can be mounted on the cuff part 79 in the same manner as described hereinbefore.

Figure 11:
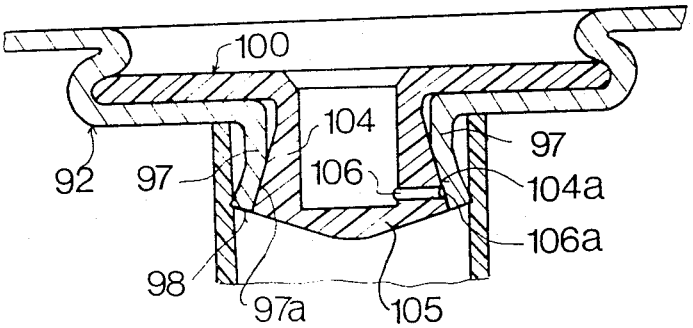
FIG. 11 shows a similar view of a further variation of the embodiment of FIG. 1.

In the embodiment of FIG. 11, the valve disc 100 has a valve head the stem part 104 of which gradually increases in diameter until it merges with the button part 105. Correspondingly, the collar portion 97 of the dome part 92 gradually widens toward the rim 98. Sealing between valve head stem part 104 and the inner surface 97*a* of collar portion 97 is effected by the snug fit of the surface 104*a* of stem part 104 on the said inner surface 97*a*, whereby duct 106 is satisfactorily obturated. A similar actuating member as shown in FIG. 10 can be used to stretch the elastically resilient stem part 104 until the entry orifice 106*a* of duct 106 emerges below the collar portion rim 98, thus opening the valve.

In an attempt to provide for a valve-and-lid assembly according to the invention in which the dome part of the lid does not penetrate so far into the upper space of the can interior 2 as in the preceding embodiments, the embodiment shown in FIG. 12 has a dome part 112 of lid 110 that protrudes upwardly, i.e. away from the can interior 2, and is crimped to clamp in the periphery of a valve disc 120 which bears an active valve part 125 with stem part 124 and valve head 125 similar to these elements shown in FIGS. 1 and 2. The collar portion in this embodiment is constituted by a circular indentation 128*a* in flat lid part 113 about the foot end 112*a* of dome part 112, whereby an annular sealing bead 128 is formed which protrudes downwardly toward the can interior 2 from the underside 113*a* of lid 110. The shoulder 126 of valve head 125 is urged firmly and sealingly with bias against this sealing bead 128, obturating the duct 135 which extends through stem part 124. The same mounting mode for generating this bias is used as in the case of the embodiment of FIG. 9.

The actuating means of the embodiment of FIG. 10 should be employed also in this case.

The stretchability of the stem part 124 can be improved in the same manner as in the embodiment of FIG. 7.

In FIGS. 13 and 14 there is illustrated a preferred way of mounting a sleeve 191 of spray head 190 in the cavity 30 of valve disc 20. In order to avoid the need for radial adjustment of a port 91*a* (FIG. 10) to register with the exit orifice 35*b* of duct 35, there are provided in the bottom 32 of cavity 30 short radial ribs 32*a* on which the straight bottom rim 192 of sleeve 191 comes to rest.

The spray head sleeve 191 fits snugly into cavity 30 and is held firmly and with good seal against the elastically resilient internal wall surface 33 thereof.

In the embodiment of FIG. 15 the valve head 125 is covered on its downwardly facing surface 125*a* by a protection cap 29 of corrosion-resistant material.

Similarly, in the embodiment of a lid shown in FIG. 16, the downwardly directed lid surface 10*a* which faces toward the can interior 2, can be coated with a similar protective layer 129. In the crimped region 15*a* of the dome part 12, there can be provided rubber elastic sealing strips 115 which can afford an additional sealing effect against the valve disc peripheral portion 21 which is to be clamped into the crimped region 15*a*.

In the embodiment of a lid shown in FIG. 17, the collar portion 117 has an end rim 118 being crimped to have a cuff part 119 thereabout which is similar to that provided in the embodiment of FIG. 10.

Bearing in mind that the material from which the lid is made is, for instance, an aluminium sheet of only 0.6 to 0.8 mm thickness, it will be understood that the cuff 119, or the outer collar flange 49 shown in FIG. 5, contribute significantly to spacing the inner wall of a riser tube affixed to the lower end of the collar portion sufficiently from the valve head button which the riser tube surrounds.

Another advantage of the novel lid according to the invention resides in the fact that the crimped zone in the dome part sidewall can be prefabricated (FIG. 16) and the valve disc bearing the valve head can then be snapped into place inside the dome part with the valve head protruding through the central dome part opening. Sealing of the valve disc is guaranteed by sealing strips 115, even when the snapped-in valve disc should not fit with complete seal in the prefabricated crimped zone of the dome part.

The protection cap 29 or layer 129 (FIGS. 15 and 16) can be made either of aluminium foil or a hard resin injection molded part, e.g. of a melamin resin or formaldehyde urea resin.

The provision of a space 27 (FIGS. 1 and 2) underneath the valve disc 22 inside the dome part 12 has the further advantage that the thickness of the valve disc 22 can be considerably greater than in the conventional gaskets used in the known aerosol spray can valves (see description of gasket 202 in FIG. 18, infra). The wide cavity 30 permits introduction of a filling head or of the stem of an atomizer head without the danger of damaging a functional portion of the valve disc or of having a lacking seal along the cavity sidewall 33, thus avoiding the fountain effect during filling that is feared when filling a conventional aerosol can through its valve.

Also, in the embodiment of FIG. 4, the sleeve or stem of a filler head or of an atomizer head can be slipped over the tubular sleeve part 50 of valve body 20 and come to rest with its lower end rim sealingly on the upper valve disc face 20*b*, thus avoiding damage or the above-mentioned undesirable fountain effect.

When fastening the valve disc in the dome part of the lid, with the valve head protruding through the central opening of the collar portion of the dome part, by the method of lengthening the stem part of the valve head when snapping the valve head with bias into position in the dome part as explained in detail in connection with FIG. 9, supra, it is of decisive importance that there be no free space provided between the underside of the flat region of the valve disc and the upper face of the underlying dome part top wall about the valve stem part. For, otherwise, when depressing the valve head, there is danger that the sealing of the periphery of the valve disc on the underlying dome part top wall will become so weak, this periphery not being clamped in, that upon an opening of the valve, liquid product will emerge around the disc periphery in what is called the undesirable "fountain" effect. In the embodiment of FIG. 9, opening pressure exerted in the valve head cavity bottom will increase the sealing effect at the periphery of the valve disc while, at the same time, opening a gap at the valve head button shoulder.

The terms "upward", "downward", "upper side" and "lower side" or "underside" refer to positions of the respective parts as shown in the accompanying drawings, while "inner" and "outer" refer to the container which can be closed by the valve-and-lid assembly according to the invention.

Figure 19:
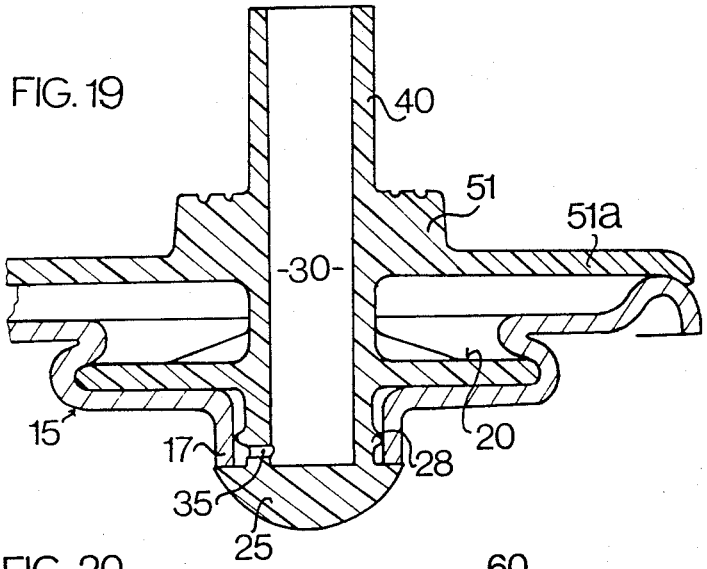
FIG. 19 shows a view similar to that of FIG. 4 in which the actuating means are somewhat differently built.

In the embodiment shown in FIG. 4, the actuating member constituted by tubular sleeve 50 can also bear an annular finger rest 51 on which two fingers can come to rest in order to exercise downward pressure and open the valve (FIG. 19). Moreover, cover disc 51*a* can extend about the finger rest 51 and the peripheral zone of cover disc 51*a* can rest on the periphery 11 of lid 10.

Figure 20:
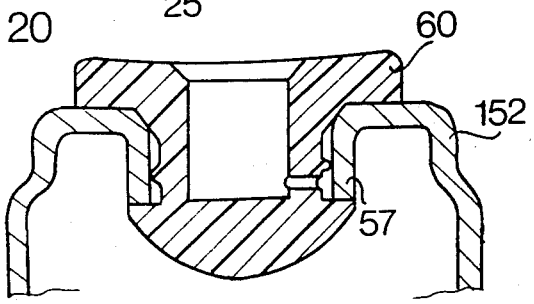
FIG. 20 shows a sixth embodiment similar to that in FIG. 9 in which the lid and a cylindrical wall of the container are integral with each other.

In the embodiment shown in FIG. 20, the valve body 60 is of the same stopper-like configuration as in the embodiment of FIG. 9, while the lid 152, which bears the same collar portion 57 and top wall 53 shown in FIG. 9 is integral, in FIG. 20, with the sidewall of a container depending from the lid itself. The container sidewall can then be sealingly connected to a container bottom part, e.g. by crimping in a manner known per se.

Figure 21:
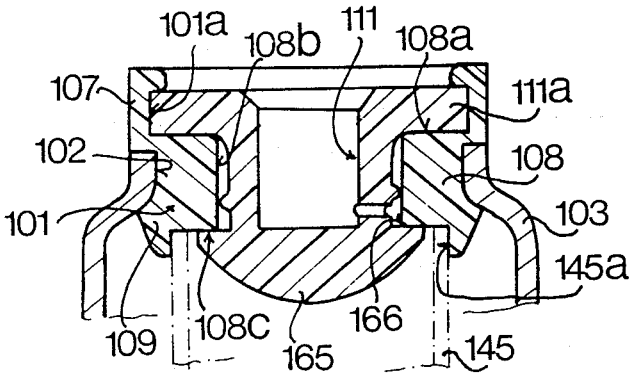
FIG. 21 shows still another embodiment, but in which the lid is made of harder synthetic plastics material.

In the embodiment of FIG. 21, the metallic lid is replaced by a stopper-like lid piece 101 which replaces the central portion of lid 110 in FIG. 12 or the entire lid, and, in the former case, is mounted firmly and sealingly in the upper opening 102 of the annular metallic lid part or in the corresponding top opening of a container sidewall 103. The lid piece 101 is made of a synthetic plastics material which is substantially harder than the synthetic material of which valve disc 101 consists. The upper portion 107 of lid piece 111 has an inner peripheral groove 101*a* of rectangular cross section in which the periphery 111*a* of valve disc 111 is clamped in sealingly and firmly. From the underside of upper lid portion 107, there depends a lower sleeve portion 108 constituting the dome part of the lid piece 101. On its outer peripheral side, lid sleeve portion 108 projects with an annular bulge 109 beneath the neck part 103*a* of container sidewall 103, while on its upper annular face 108*a*, it supports the underside of valve disc 111. The latter is clamped into the central opening 108*b* of lid sleeve portion 108 by having the shoulder 166 of valve head 165 rest against the underside 108*c* of sleeve portion 108 with bias in the same manner as described relative to FIG. 9.

A riser tube 145 can be fastened in a corresponding recess 145*a* in the underside of sleeve portion 108.

Figure 22:
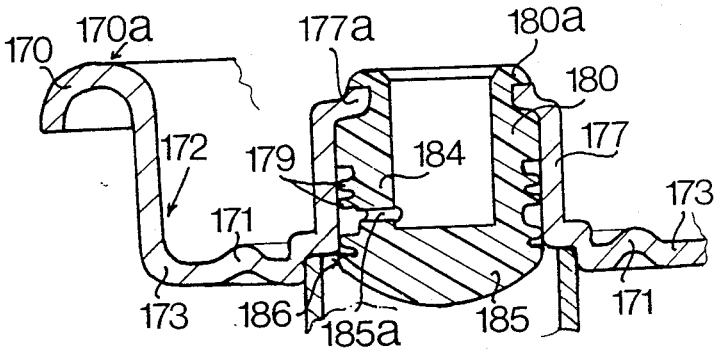
FIG. 22 shows a further embodiment somewhat similar to that shown in FIG. 10.

FIG. 22 shows an embodiment in which the valve body 180 is of somewhat similar construction as in the embodiment shown in FIG. 10. The dome part 172 of the lid, however is vaulted downwardly from the outer surface 170*a* of the very short flat lid part 170, and is provided in its top part 173 with an annular indented bead 171 which reinforces the dome part 172 against being distorted when the periphery at 170*b* of the lid is crimped on to a container sidewall (not shown). The collar portion 177 extends in this embodiment, axially outwardly from the top wall 173 of the dome part sidewall 177, at the upper free end 177*a* of which there is firmly mounted the upper end 180*a* of valve body 180. The valve head 185 has its contact face 186 at its periphery and engages sealingly the inner wall 178 of collar portion 177. Several annular ribs 179 about the valve disc stem part 184, above and below duct 185*a* through the valve disc, engage the same inner wall 178 and effect a type of labyrinth seal therewith. Actuation of the valve in this assembly has been described in connection with FIG. 10.

Figure 23:
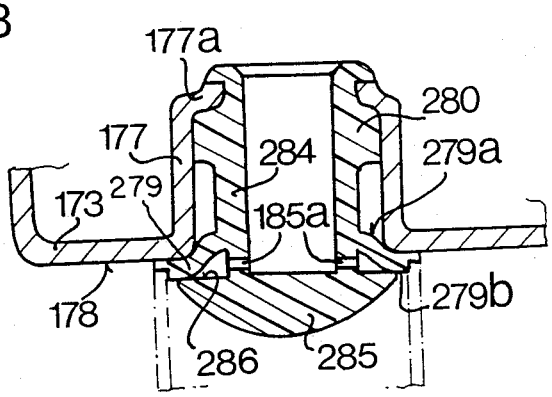
FIG. 23 shows a similar embodiment as in FIG. 22 but with an additional sealing element.

A very similar embodiment is shown in FIG. 23, and like numerals therein indicate identical parts in FIGS. 22 and 23. However, in this embodiment, the valve body 280 has a sealing element which is a flexible annular flange 279 surrounding and integral with valve head stem 284, which flange comes to lie with its upper side 279*a* against the inner zone 178 of the lid underside about the bottom opening of collar portion 177, while the contact face 286 of valve head 285 sealingly presses with bias against the underside 279*b* of annular flange 279. The actuating means for this embodiment are preferably identical with those shown in FIG. 10 and operate in the same manner when the valve is to be opened.

Finally, FIG. 18 shows a conventional valve-and-lid assembly comprising an atomizer head and dependent sleeve as actuating member. Such known valve comprises a lid 200, a valve housing 201 which is held at the lid 200 by means of an indented portion 200*a* of the latter, an elastically resilient valve disc or gasket 202 the peripheral region 202*a* of which is wedged in between a dome top wall 212 and the top rim 203 of valve housing 201. A steel spring 204 one end of which rests on the housing bottom 205, urges a valve body 206 with its upper obturating rim 207 into sealing engagement with the underside of valve disc 202. A sleeve of the atomizer head 210 is inserted into the top opening 213 of dome top wall 212 and rests upon the top face 206*a* of valve body 206. Depression of the atomizer head 210 compresses the spring 204 and opens a gap between the obturating rim 207 and the valve disc 202, whereupon product can flow from a riser tube 215 through valve housing 210 and through the aforesaid gap into a port 214 in sleeve 211 and through the interior of the latter to the spray nozzle 216 in atomizer head 210.

It will be readily understood that it can happen frequently in practice that especially the gasket 202 is damaged when the sleeve 211 or a filling head in the filling station for product or propellant is forced through the orifice 217 of gasket 202 into the valve housing 201 into engagement with the valve body 206.

In contrast thereto, insertion of an atomizer head sleeve or a filler head into the cavity 30 of the valve disc 20 (FIG. 1) and the long sliding insertion thereof along the sidewall 33 of cavity 30 can do little damage.

The terms "upward", "downward", "upper side" and "lower side" or "underside" refer to positions of the respective parts as shown in the accompanying drawings, while "inner" and "outer" refer to the positioning of parts of the Valve-and-lid assembly according to the invention in relation to the container that can be closed by the assembly.

We claim:

1. Self-closing valve-and-lid assembly adapted for closing the top end opening of a container fillable with pressurized product, and having a central assembly axis, comprising I. a lid the periphery of which is adapted for being sealingly connected with a top rim of a container sidewall surrounding the said container top opening, and which lid extends generally transverse to said central assembly axis, (i) said lid having a central dome part and a central opening in the middle of said dome part, and being rigid under conditions of filling product into, and discharging product from said container, (ii) said lid extending generally in a main lid plane transverse to said central assembly axis, (iii) said dome part having a top wall and a circumferential sidewall which latter extends transverse to said main lid plane, (iv) said lid further comprising a collar portion projecting from said dome part and having an inner collar wall extending substantially axially relative to said central assembly axis and further having a free end comprising an annular rim means about said central dome part opening;

II. a valve body of elastically resilient material, comprising (a) a valve disc having a peripheral disc zone, said valve disc having an outer surface adapted for facing away from a container and an opposite underside, inner surface adapted for facing toward the interior of the container and resting, in said peripheral disc zone, on said dome part top wall, (b) a reduced radial diameter stem part having a sidewall and extending from said valve disc axially relative to said central assembly axis through said collar portion, (c) a valve head at the lower end of said stem part being of larger radial diameter than the stem part, (d) an annular shoulder on said valve head, facing toward said collar portion and bearing an annular contact zone being in sealing engagement with said free end of said collar portion when said valve-and-lid assembly is in closed position, (e) at least one duct for the passage of product, extending through said valve disc and in substantially axial direction through said valve stem part, and having a first, outer orifice in said outer valve disc surface and a second, inner orifice, near said annular shoulder of said valve head, inside the annular contact zone thereon, and (f) annular sealing means intermediate said valve disc and said valve head and engaging said inner collar wall at all times, to seal off product flow, said second orifice of said duct being located further away from said valve disc than said annular sealing means; and III. finger-engagable actuating means for deforming said valve body in a manner such that at least part of said annular contact zone on said annular valve head shoulder is moved out of engagement with said annular rim means of said collar portion, thereby opening a free passage through at least one duct from the space adjacent said annular valve head shoulder outside said annular contact zone to outside said outer valve disc surface.

2. The valve-and-lid assembly of claim 1, wherein said valve body has a cavity therein which has a bottom end in or near said valve head and opens in said outer disc face, said first orifice of said duct opening in said cavity.

3. The valve-and-lid assembly of claim 2, wherein said actuating means are elongated and act upon the bottom of said cavity, depressing said valve head during opening of said valve-and-lid assembly for the discharge of product from a container, until said annular shoulder on said valve head frees said annular rim means of said collar portion and together therewith said second orifice of said valve body duct.

4. The valve-and-lid assembly of claim 2, wherein said actuating means comprise a tubular part on siad outer valve disc surface and being integral with said valve disc, the hollow interior of said tubular actuating part being coaxial with said cavity.

5. The valve-and-lid assembly of claim 1, wherein said valve head has a cavity therein which has a bottom and opens in said outer disc face, said first orifice of said duct opening in said cavity, said cavity extending axially through said stem part with the latter constituting the enclosing sidewall of the cavity, said valve head comprising in said sidewall an annular zone of reduced thickness and thereby being more easily axially stretchable.

6. The valve-and-lid assembly of claim 2, wherein said duct is inclined toward said central assembly axis, with its first orifice in said cavity and the second orifice in said sidewall of said stem part near said annular shoulder of said valve head above the latter, but at a level of said stem part below said first orifice.

7. The valve-and-lid assembly of claim 2, wherein said dome part protrudes downwardly from said main lid plane depending from said lid on the side of the latter adapted for being turned toward the interior of a container.

8. The valve-and-lid assembly of claim 1, wherein said collar portion has a free end below said main lid plane constituting said annular rim, and is crimped to form an outwardly and upwardly bent marginal portion about said free end.

9. The valve-and-lid assembly of claim 1, wherein said dome part protrudes upwardly from said main lid plane on the side of said lid adapted for being turned away from the interior of a container so as to face toward the outside, said collar portion consists of an annular bead means about said central opening of said dome part and protrudes downwardly out of said main lid plane on the side of said lid adapted to be turned toward the interior of a container, said valve body having a cavity therein which has a bottom and opens in said outer disc face, said first orifice of said duct opening in said cavity, said cavity extending axially through said stem part with the latter constituting a sidewall of the cavity and comprising in said sidewall an annular zone of reduced thickness and thereby being more easily axially stretchable, and said actuating means being elongated and acting upon the bottom of said cavity, depressing said valve head, during opening of said valve-and-lid assembly for the discharge of product from a container, until said annular shoulder frees said annular rim means of said collar portion and together therewith said second orifice of said valve head duct.

10. The valve-and-lid assembly of claim 1, wherein said valve body has a cavity therein which has a bottom and opens in said outer disc face, said first orifice of said duct opening in said cavity, said cavity extending axially through said stem part with the latter constituting a sidewall of the cavity and comprising in said sidewall an annular zone of reduced thickness and thereby being more easily axially stretchable.

11. The valve-and-lid assembly of claim 1, wherein said dome part protrudes from said lid on the side thereof adapted to face away from said container, said circumferential sidewall thereof having a neck portion below the level of said valve head and comprising a passageway, and wherein said lid further comprises a riser tube having an upper open end mounted in said passageway.

12. The valve-and-lid assembly of claim 1, wherein said dome part and said collar portion of said lid are integral with each other and constitute a stopper body adapted for being fitted sealingly in the top opening of a container, said stopper body comprising a central stopper passage having an upper and a lower open end and an inner passage wall and being adapted for receiving said stem part of said valve body therein, said stopper piece having an outer annular face about the upper open end, and an inner annular face about the lower open end, of said central stopper passage; an annular sleeve joined to said stopper body and extending axially upwardly therefrom, and being merged with said stopper body outside the periphery of said outer annular face thereof, whereby the underside of said valve disc comes to rest on said outer annular face while said annular shoulder of said valve head comes to rest on the inner annular face of said stopper body, and said annular sealing means sealingly engage said inner passage wall at all times.

13. The valve-and-lid assembly of claim 12, wherein said axially upwardly extending annular sleeve on said stopper body has an upper open end and a radially inwardly projecting flange about said upper open sleeve end, said flange being adapted for resting on the outer surface of said valve disc.

14. A container lid being usable in a self-closing valve-and-lid assembly adapted for closing the open top end of a container fillable with pressurized product, which lid has a central axis, the periphery of said lid being adapted for sealing connection with a top rim of a container sidewall surrounding the said container top opening and extending in a plane generally transverse to said lid axis, said lid having a central dome, a foot zone about said dome, a central opening in the middle of said dome and a collar portion protruding axially from said dome, about said central opening, and being rigid under conditions of filling product into, and discharging product from said container, said lid having a flat lid part about said dome and extending generally in a main lid plane transverse to said central lid axis, between said periphery, being connectable to said top rim of said container sidewall, and said foot zone, said dome having a top wall extending perpendicular to said lid axis and a circumferential sidewall which latter extends axially transverse to said main lid plane, and merges with said flat lid part in said foot zone, said dome protruding upwardly from said flat lid part on the side of the latter adapted for being turned away from the interior of a container, and said collar portion extending in axial direction upwardly from said dome top wall and having an annular rim, about said central dome opening, facing upwardly in axial direction.

15. A container lid being usable in a self-closing valve-and-lid assembly adapted for closing the open top end of a container fillable with pressurized product, which lid has a central axis, the periphery of said lid being adapted for sealing connection with a top rim of a container sidewall surrounding the said container top opening and extending in a plane generally transverse to said lid axis, said lid having a central dome, a foot zone about said dome, and a central opening in the middle of said dome, and being rigid under conditions of filling product into, and discharging product from said container, said lid having a flat lid part about said dome and extending generally in a main lid plane transverse to said central assembly axis, between said periphery, being connectable to said top rim of said container sidewall, and said foot zone, said dome having a top wall and a circumferential sidewall which latter extends generally transverse to said main lid plane, and merges with said flat lid part in said foot zone, a collar portion of said dome extending axially relative to said central lid axis and ending in an annular rim about said central dome opening;

said dome protruding upwardly from said flat lid part on the side of the latter adapted for being turned away from the interior of a container face toward the outside, and said collar portion extending in axial direction downwardly from said dome and consisting essentially of an annular flange-forming fold about said foot zone of said dome, said fold protruding downwardly from the side of said flat lid part adapted to be turned toward the interior of a container.

16. A container lid being usable in a self-closing valve-and-lid assembly adapted for closing the open top end of a container fillable with pressurized product, which lid has a central axis, the periphery of said lid being adapted for sealing connection with a top rim of a container sidewall surrounding the said container top opening and extending in a plane generally transverse to said lid axis, and said lid has a central dome part and a central opening in the middle of said dome part, and is rigid under conditions of filling product into, and discharging product from said container, said lid extending generally in a main lid plane transverse to said central axis, said dome part having a top wall extending perpendicularly to said central axis, and a circumferential sidewall which latter extends axially out of said main lid plane, a collar portion of said dome part extending axially relative to said central axis and downwardly away from said dome top wall, on the side of said lid adapted for facing toward the interior of the container, and ending in an annular rim means about said central dome part opening, and said annular rim means of said collar portion has a free end below said main lid plane, and is crimped to form an an outwardly and upwardly bent marginal portion about said free collar portion end.

17. The container lid of claim 16, wherein said dome part protrudes from said lid on the side of the latter adapted to face toward the interior of the container.

18. The container lid of claim 17, wherein said circumferential sidewall of said lid dome part comprises an annular region adapted to be crimped for firmly clamping in a peripheral zone of a valve disc;

and said collar portion has an internal cylindrical sidewall coaxial with said central lid axis and adapted for receiving therein a sealing element capable of sliding along said cylindrical sidewall to remain at all times in sealing engagement with said sidewall during axial movement of said element.

19. Self-closing valve-and-lid assembly adapted for closing the top end opening of a container fillable with pressurized product, and having a central assembly axis, comprising (I) a lid the periphery of which is adapted for being sealingly connected with a top rim of a container sidewall surrounding the said container top opening, and extending generally transverse to said central assembly axis, said lid having a central dome, a foot zone about said dome, and a central opening in the middle of said dome, and being rigid under conditions of filling product into, and discharging product from said container, said lid having a flat lid part about said dome and extending generally in a main lid plane transverse to said central assembly axis, between said periphery, being connectable to said top rim of said container sidewall, and said foot zone, said dome having a top wall and a circumferential sidewall which latter extends generally transverse to said main lid plane, and merges with said flat lid part in said foot zone, said dome protruding upwardly from said flat lid part on the side of the latter adapted for being turned away from the interior of a container face toward the outside, said collar portion extending in axial direction upwardly from said dome top wall and having an annular rim about said central dome opening facing upwardly in axial direction;

(II) a valve body of elastically resilient material, comprising (a) a valve disc part at the upper end of said valve body and having an outer surface adapted for facing away from a container, and an opposite underside of said disc part resting on said upwardly facing rim of said collar portion, (b) a neck portion of narrower diameter than said disc part, and depending from the underside of said disc part, a sealing stem part depending from, and having a larger diameter than, said neck portion, said sealing stem part having an upper end face sealingly engaging the underside of said dome top wall, a neck stem part having a smaller diameter than said sealing stem part, and than the inner width of said dome, and extending from the sealing stem part downwardly into said dome, a cavity extending axially in said valve body and opening out of said outer surface of said valve disc part, duct means leading from said cavity outwardly and having an orifice in the outer wall of said neck stem part in a zone thereof out of engagement with the interior wall of said dome, and sealing means comprising a valve head depending from said neck stem below said duct orifice in said outer stem part wall, said valve head having about the periphery thereof a sealing contact face being in sealing contact with the lower foot zone of said dome merging with said flat lid part, when said neck stem part is in unextended position, and freeing a gap with said lower dome foot zone when said neck stem part is extended in axially downward direction.

20. The valve-and-lid assembly of claim 19, wherein said valve body comprises, above said valve head, a plurality of radially extending annular ribs about said neck stem part, said duct orifice being located intermediate two adjacent ones of said annular ribs, any ribs located above said duct orifice engaging with their periphery the interior wall of said dome in closed as well as in open position.

21. The valve-and-lid assembly of claim 19, wherein said valve body comprises an annular flange having a diameter larger than the internal width of said dome and sealingly engaging with its upper side the underside of said dome foot zone in which the lower end region of said dome merges with said flat lid part, said duct orifice is located below said annular flange and above said valve head and the diameter of said valve head being such that its periphery sealingly engages the underside of said flange when said neck stem part is in unextended closing position; and a gap is opened between said valve head periphery and said flange underside when said valve neck stem part is in axially downwardly extended opening position.

22. A self-closing valve-and-lid assembly adapted for closing the top end opening of a container fillable with pressurized product, and having a central assembly axis, comprising I. a lid the periphery of which is adapted for being sealingly connected with a top rim of a container sidewall surrounding the said container top opening, and which lid extends generally transverse to said central assembly axis, (i) said lid having a central dome part and a central opening in the middle of said dome part, and being rigid under conditions of filling product into, and discharging product from said container, said lid extending generally in a main lid plane transverse to said central lid axis, said dome part having a top wall extending perpendicularly to said central axis, and a circumferential sidewall which latter extends axially out of said main lid plane, said dome part protruding from said lid on the side of the latter adapted to face toward the interior of the container, a collar portion of said dome part extending axially relative to said central assembly axis and downwardly away from said dome top wall, Σsaid collar portion comprising a lower internal wall zone of downwardly and radially outwardly flared, substantially conical configuration; and II. a valve body comprising (a) a radially extending valve disc having a disc periphery, an outwardly facing upper surface and a lower surface destined for facing inwardly toward the container;

(b) a valve head having a stem portion of narrow diameter merged at its upper end with said lower surface of said valve disc, and a frustoconical head portion having a conically tapered sidewall with a narrower end of said frustoconical head portion merging with the lower end of said stem portion and a larger diameter end of said frustoconical head portion being the lower frontal end surface of said valve head, at least one of said valve disc and said valve stem part having an annular elastically resilient valve portion being deformable toward axial downward direction, (c) the taper and axial height of said frustoconical head portion being such as to fit said head portion sealingly in said lower internal wall zone of said collar portion;

(d) an axially extending cavity having an opening in said upper surface of said valve disc and a closed bottom end in said head portion of said valve head, (e) duct means extending through the interior of said head portion and having a first orifice in said cavity and a second orifice in said conically tapered sidewall, at an intermediate annular zone thereof being in sealing engagement with said lower internal wall zone of said collar portion when said valve head is in closing position in said lid collar portion, but is out of engagement with said lower internal wall zone, with said second orifice being open, when said valve body is axially downwardly stretched so that a lowermost annular zone of said valve head is moved downwardly out of the lower end of said outwardly flared lower internal wall zone of said collar portion.

* * * * *